US006601518B1

(12) United States Patent
Demmig et al.

(10) Patent No.: US 6,601,518 B1
(45) Date of Patent: Aug. 5, 2003

(54) SYSTEM FOR SECURING AND/OR CONTROLLING THE FINAL POSITION OF A RAIL

(75) Inventors: Albrecht Demmig, Wusterwitz (DE); Hans-Ulrich Dietze, Wusterwitz (DE); Hubertus Höhne, Butzbach (DE)

(73) Assignee: Werth Messtechnik GmbH, Giessen (DE)

( * ) Notice: Subject to any disclaimer, the term of this patent is extended or adjusted under 35 U.S.C. 154(b) by 0 days.

(21) Appl. No.: 09/926,621

(22) PCT Filed: May 26, 2000

(86) PCT No.: PCT/EP00/04819

§ 371 (c)(1),
(2), (4) Date: Mar. 15, 2002

(87) PCT Pub. No.: WO00/73120

PCT Pub. Date: Dec. 7, 2000

(30) Foreign Application Priority Data

May 28, 1999 (DE) ..... 199 24 427

(51) Int. Cl.[7] ..... E01B 25/06
(52) U.S. Cl. ..... 104/130.01; 246/415 R
(58) Field of Search ..... 238/151; 104/88.02, 104/130.11, 130.01; 246/415 R, 435 R, 218, 226

(56) References Cited

U.S. PATENT DOCUMENTS 1,825,469 A * 9/1931 Milton ..... 246/225
3,918,665 A * 11/1975 Alimanestianu et al. .... 246/415 R
4,022,409 A * 5/1977 Ensink et al. ..... 246/415 R
4,059,054 A * 11/1977 Alimanestianu et al. . 104/88.02

FOREIGN PATENT DOCUMENTS

DE 4403259 8/1995
DE 29510718 1/1996
FR 2387833 11/1978

* cited by examiner

*Primary Examiner*—S. Joseph Morano
*Assistant Examiner*—Lars A. Olson
(74) *Attorney, Agent, or Firm*—Dennison, Schultz & Dougherty

(57) ABSTRACT

The invention relates to a system for securing and/or controlling the final position of a tongue rail (14) that can be adjusted in relation to a rigid rail (12). A catch element extends from said tongue rail and interacts with a lever element in such a manner that in the respective final position of the tongue rail the latter is supported and the position of the tongue rail is measured.

39 Claims, 5 Drawing Sheets

SYSTEM FOR SECURING AND/OR CONTROLLING THE FINAL POSITION OF A RAIL

Figure 1:
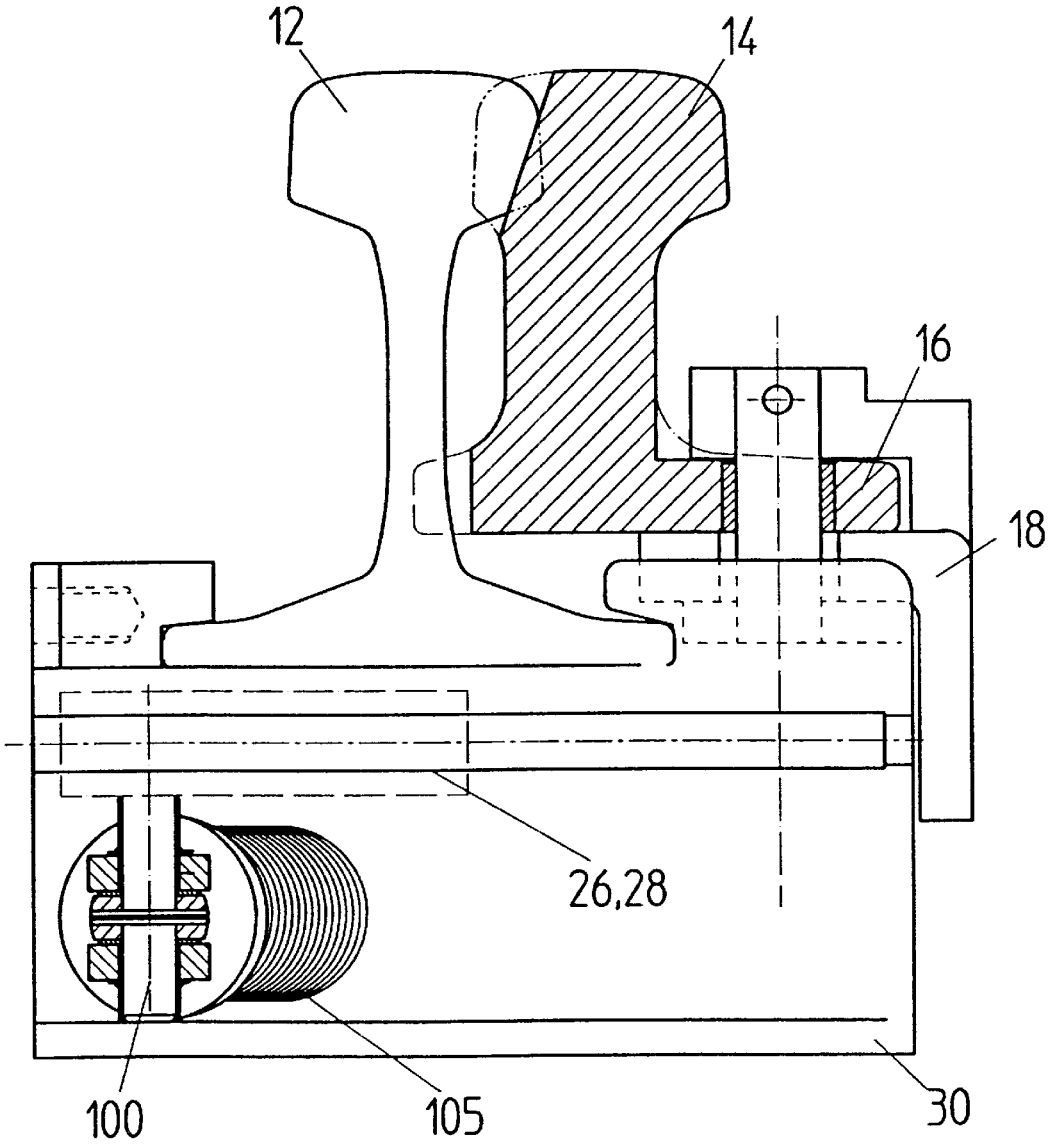

The invention relates to a system for securing and/or controlling the final position of a first rail, e.g. a tongue rail, that can be adjusted in relation to a stationary second rail, e.g. a rigid rail, wherein the first rail interacts with at least one retaining element that is acted upon by a spring element and can be shifted in relation to a guide element that is rotatable about a stationary first axis, said retaining element in turn supporting the first rail in its respective final position.

In particular, the invention refers to a system for securing and/or controlling the final position of a first rail, e.g. a tongue rail, that can be adjusted in relation to a stationary second rail, e.g. a rigid rail, wherein the first rail interacts with at least one retaining element that is acted upon by a spring element and which, in turn, supports the first rail in its respective final position.

A system of the aforementioned type can be found in DE 295 10 718 U1. The known control mechanism for a switch ensures that the tongue rail always assumes only one of the two final positions, i.e. the abutting or remote final position. For this purpose, an adjusting rod leading to an axis of rotation extends from the tongue rail, two symmetrically arranged retaining and guide element arrangements which are each swivable about a stationary axis extending for their part from said adjusting rod. In this case, a spring tension acts on the retaining element in such a way that the guide/retaining element arrangements must always assume, due to the spring tension, one of two stationary positions which each correspond to one of the final positions of the tongue rail. The axis of rotation from which the adjusting rod extends is thereby found in the respective final position on opposite sides of a straight line connecting the stationary axes of the guide/retaining elements. This means that an often undesired space requirement is needed. Furthermore, considerable forces are required to overcome the spring elements acting on the retaining elements when adjusting the guide/retaining element arrangements. Independent of the previously known adjusting device, additional end position controls are required in order to be able to monitor the position of the tongue rail. Corresponding final position controls are thereby fastened to the bearing rail outside of the ties, control rods extending from the tongue rails themselves to the final position controls. Due to the additional structurally dependent elements, it is necessary to regularly check said elements with respect to their efficiency.

A change-over mechanism for switches can be found in FR A 2 387 833. To adjust the tongue switch, an adjustable lever is turned about a first axis from which a connecting rod extends that is connected with a toggle lever on which a correcting element is articulated that leads to the tongue rail. The first axis extends at a right angle to the swivel axes of the toggle lever and correcting element. A prestressed retaining element that can be turned about a stationary axis acts on the pivotal point between toggle lever and correcting element.

A device for adjusting and locking or unlocking a rail section is described in DE 44 03 259 A1. Final positions of the rail sections can be stopped by means of a prestressed ball element.

The object of the present invention is to provide a system of the aforementioned tape which, with a compact and structurally low-maintenance construction ensures that a movable rail, e.g. a tongue rail, is securely held in its final positions, whereby the position should be simultaneously controlled. It should thereby be ensured, independent of the spring tensions required for fixing the final positions, that undesirably high adjusting forces must be applied to overcome the spring tensions when adjusting the first rail.

According to the invention, the object is solved essentially thereby that a lever element is pivoted so as to be stationary about a second axis, stationary to the stationary first axis of the guide and retaining element, said lever element being connected with the retaining element and interacting with at least one catch element extending from the adjustable first rail, in such a way that, in the respective final position of the first rail, the retaining element is acted upon in such a way that the respective final position can be supported and controlled, whereby the lever element is articulated about a third axis with the retaining element via a hinged element that is flexibly connected with the lever element, said third axis being parallel to the first and second axis.

According to the invention, a system is proposed with which the first rail, e.g. tongue rail, is additionally fixed in its respective final position via the spring element acting on the retaining element. To this end, the catch element extends from the rail, said catch element interacting with the retaining element via the lever element or the hinged element flexibly connected thereto in such a way that, when in one of the final positions, the spring tension acts on the catch element in such a way that it is secured, and thus also the first rail. In particular, the tension produced by the spring element acting on the retaining element is thereby always directed in such a way that the lever element endeavours to interact with the catch element in such a way that the final position of the first rail to be obtained is supported when said rail is moved, that is, especially in the last third of the adjusting movement.

Furthermore, a switch element should be assigned to the catch element in such a way that its actuator produces switching signals dependent on the position of the catch element, namely, when the first rail is in one of its final positions. In particular, two switch elements, e.g. snap switches, are allocated to the catch element, the actuator of each switch element then engaging in a recess in the catch element when the first rail, e.g. tongue rail, is in one of its final positions. As a result, the position of the rail can be controlled to the extent that both the final positions and the intermediate positions can be checked based on the signals derived from the switch elements. Since the switch element or switch elements interact directly with the catch element, which is in turn connected with the adjustable rail, a compact structure results in such a way that the overall system, including the switches, can be positioned within a tie field, so that the bearing rails outside of the ties otherwise required, to which final position controls are fastened and which, in turn, are connected with tongue rails via control rods, can be omitted.

Alternatively, the retaining element and switch element can form a unit or actuate the latter. There is also the possibility of being able to use, or construct accordingly, other elements of the system that are moved or adjusted with the movement of the first rail to release a signal, e.g. a switch signal.

In particular, the invention is distinguished therein that two catch elements extend from the adjustable first rail, whereby one of the catch elements interact with the lever element in each of the final positions of the rail in such a way that the catch element is secured in its position, whereby a movement is first supported.

Preferably, the lever element is a two-armed element, a glide element sliding along each catch element, e.g. a roll, being provided on opposite sides of its axis of rotation. In particular, the corresponding glide elements are placed on each end of a straight arm or arm section which passes over into an angular section on which the hinged element leading to the retaining element is articulated.

The catch element is thereby configured, or the glide element aligned to it, in such a way that, when the first rail is in one of the final positions, one of the glide elements interacts with one of the catch elements and the other glide element is disengaged with the other catch element. As a result, the lever element can be selectively swivelled due to the connection with the retaining element in such a way that said lever element acts on the catch element interacting with it, that its adjustment is supported insofar as the rail connected with the catch element reaches its final position and remains there.

In particular, to obtain a compact unit and to ensure that the force required to adjust the first rail does not have to overcome undesirably high spring tensions, it is provided that, in each of the final positions of the first rail, the retaining element is acted upon by a force in the same direction, in particular in direction of the first rail.

To ensure an additional securing of the catch element and thus the first rail in the respective final position, it is provided that the catch element have a recess in its surface interacting with the glide element, the glide element engaging in said recess in the final position of the first rail. The recess is thereby arranged, in particular, in the intersecting area of two surfaces of the catch element preferably extending at a right angle to one another.

According to a further embodiment of the invention, it is provided that the lever element is placed between the catch elements connected with the first rail, whereby the lever element slides and rolls off with its glide elements along surfaces of the catch element facing one another.

In order that the lever element interacts with only one of the glide elements with one of the catch elements prior to the first rail reaching one of the final positions and when in this final position, it is provided that each catch element has two sections, a protruding and an inset section, staggered vis-à-vis one another, in their surfaces facing one another, the recess in which one of the glide elements engages when a first rail is in one of the final positions being provided in the respective protruding section. Preferably, the sections thereby extend parallel to one another and parallel to the shift path of the catch.

To ensure that only one glide element interacts with a catch element in the respective final position or just before it, while the other glide element is free, the protruding sections extend at a distance from one another in projection at a right angle to the shift path of the catch elements, in direction of the shift path.

With respect to the monitoring of the final position, the two existing switch elements, e.g. snap switches, should interact with their respective actuator with a surface of one of the catch elements that extends opposite the surface along which one of the glide elements of the lever element slides. However, this is not an imperative feature.

In particular, the invention is characterized therein that the system comprises two guide elements, preferably configured as a tubular guide, which are each swivable about a stationary axis, that the retaining element which is axially adjustable or shiftable to the guide element extends by area within the guide elements or partially surrounds it as an arm bracket, that every arm bracket is prestressed vis-à-vis the guide element by means of the spring element, e.g. compression spring, preferably surrounding it, that the retaining elements are pivotable about a common axis that extends parallel to the stationary axes and which forms the second axis from which the hinged element that is connected with the lever element extends. In this case, the second axis can be adjusted along a straight line that extends parallel or almost parallel to the shift path of the catch element when the first rail and thus the catch element is adjusted.

In particular, the unit formed by the guide and retaining elements is arranged so as to be symmetrical to the straight line along which the second axis can be adjusted.

To ensure that the spring tension always acts in a specific direction on the lever element, the second axis, from which the hinged element connected with the lever element extends, extends independent of the position of the first rail, due to the construction according to the invention, on one side of a straight line intersecting the first axes, in particular between the straight line and the first rail.

In order to be able to adjust the catch element together with the movement of the first rail with low friction and little support structure, the catch element is intersected by a guide shaft which extends from a mounting support or a housing that should extend within a tie field, namely directly or almost directly below the rails. As a result, especially the tamping of a track is not prevented.

In a known construction, a block proceeds from the first rail, said block then in turn being connected with the catch element via a fastening element, e.g. threaded rod, whereby the distance between the catch element and the block can be adjusted. As a result, the switching point of the switch element can be varied.

The compact construction of the system can also be produced, in particular, thereby that the units formed by the guide and retaining elements extend in a first plane and the catch elements in a second plane extending parallel thereto in the mounting support or housing which is situated in the tie field.

The catch element itself has a rectangular shape with, in particular, an L-shaped or T-shaped geometry in a top view.

The hinged element itself has two axes of rotation, a first axis of rotation of which coincides with the second axis intersecting the retaining element. An arm extends rotatably from the second axis of rotation, said arm being a section of the lever element which is preferably configured in an L-shape and whose arms preferably also comprise an obtuse angle. Moreover, the two axes of rotation intersect a plate or fishplate element of the joint element, the plate or fishplate element can have a recess in its peripheral area on the lever side in which the glide element close thereto engages when the first rail is in an abutting position, the other glide element simultaneously engaging in the recess of one of the catch elements allocated to the final position corresponding to the abutting position, whereby the axis of rotation of the lever element extends between the axis of the retaining element and the second axis of rotation of the joint element. As a result, the forces produced by the spring elements are transmitted to the catch element via the joint element and the lever element in such a way that it supports the retention of the first rail in its final position.

The adjustment in preferably the last third of the adjustment path is supported thereby that the roller element engages in the recess adapted to its geometry and thereby that the then effective forces of the spring press the roller element more or less completely into the recess.

The object of the invention is also solved, in particular, by a system for securing and/or controlling the final position of a first rail, e.g. tongue rail, that can be adjusted in relation to a stationary second rail, e.g. rigid rail, the first rail interacting with at least one retaining element that is acted upon by a spring element, which, on the one hand, supports the first rail in its respective final position, therein that at least one catch element proceeds from the adjustable first rail, said catch element interacting with the retaining element in such a way that the retaining element is acted upon by the force in the respective final position in such a way that the respective final position can be supported and controlled.

The retaining element can thereby be adjusted by spring tension at a right angle or almost at a right angle to the shift path of the catch element and interact with a coulisse extending from the catch element in such a way that the first rail is supported in its movement to the final position by the spring tension transmitted via the retaining element. The coulisse itself can be a projection or an indentation of an effective width which corresponds to the first rail in its adjustment path length supported by the retaining element.

At least one signal generator is allocated to the catch element itself, said signal generator generating the signals that can be allocated to the adjustment path, in particular the final positions of the first rail. In this case, the signal generator and the retaining element can form a unit.

Further details, advantages and features of the invention can be found not only in the claims, the features that can be found therein—alone or in combination—but also in the following description of a preferred example of an embodiment that can be found in the drawings, showing.

Figure 2:
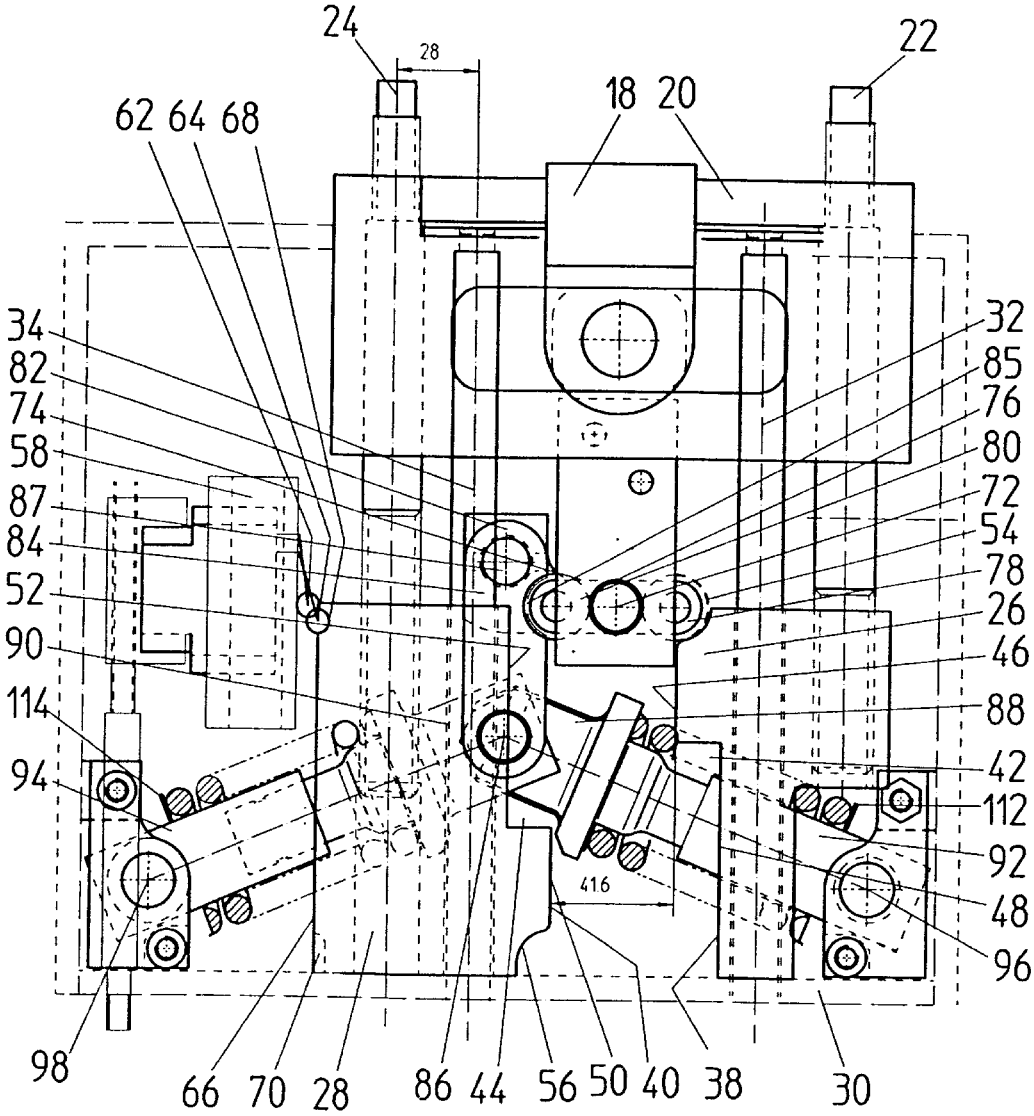
Figure 3:
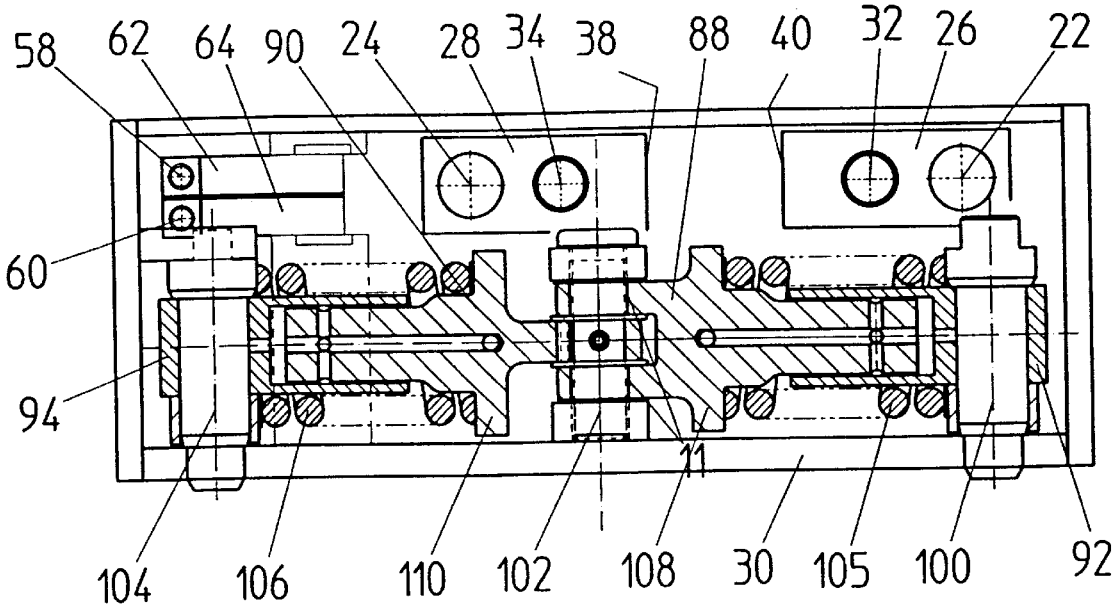
Figure 4:
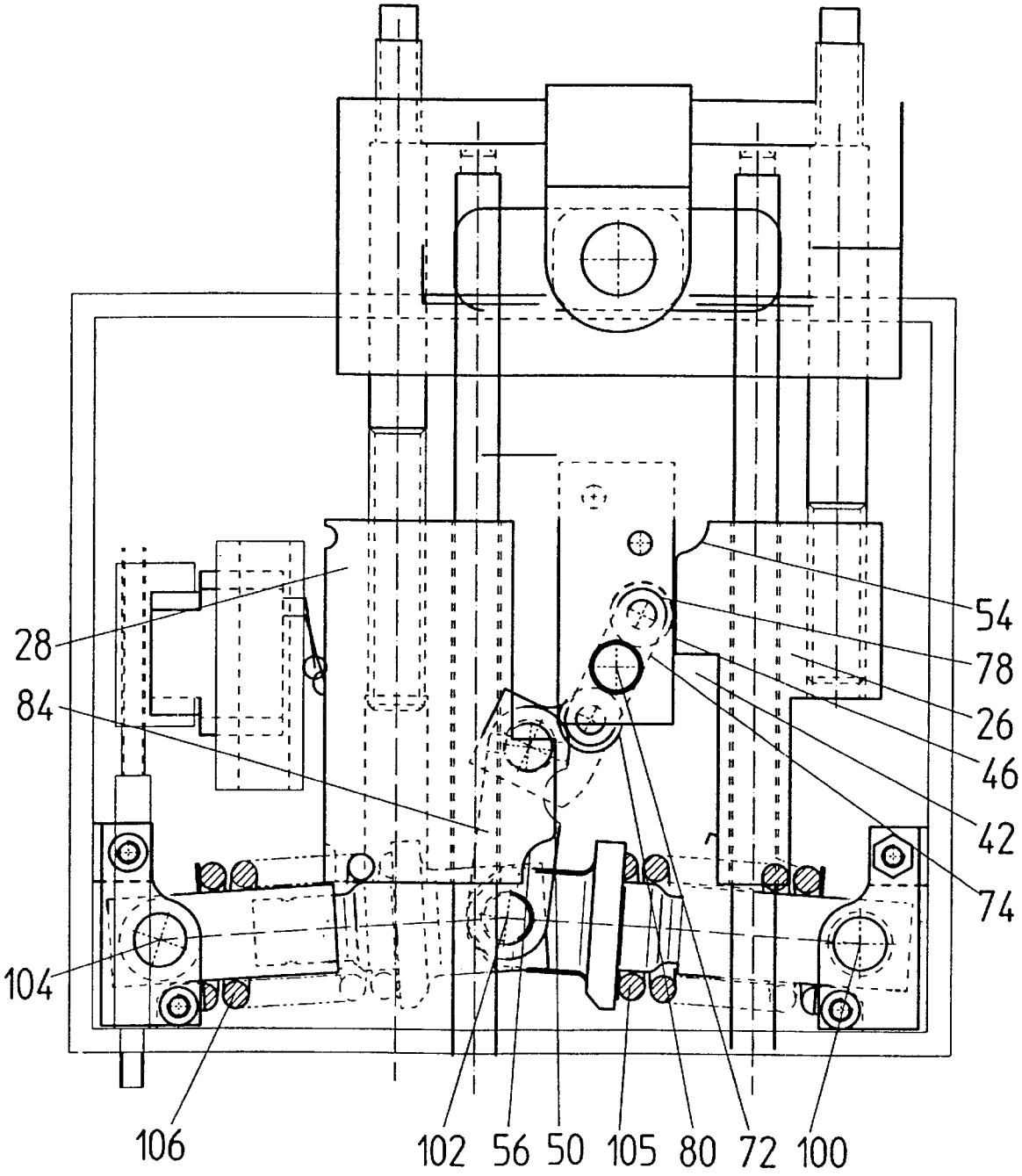
Figure 5:
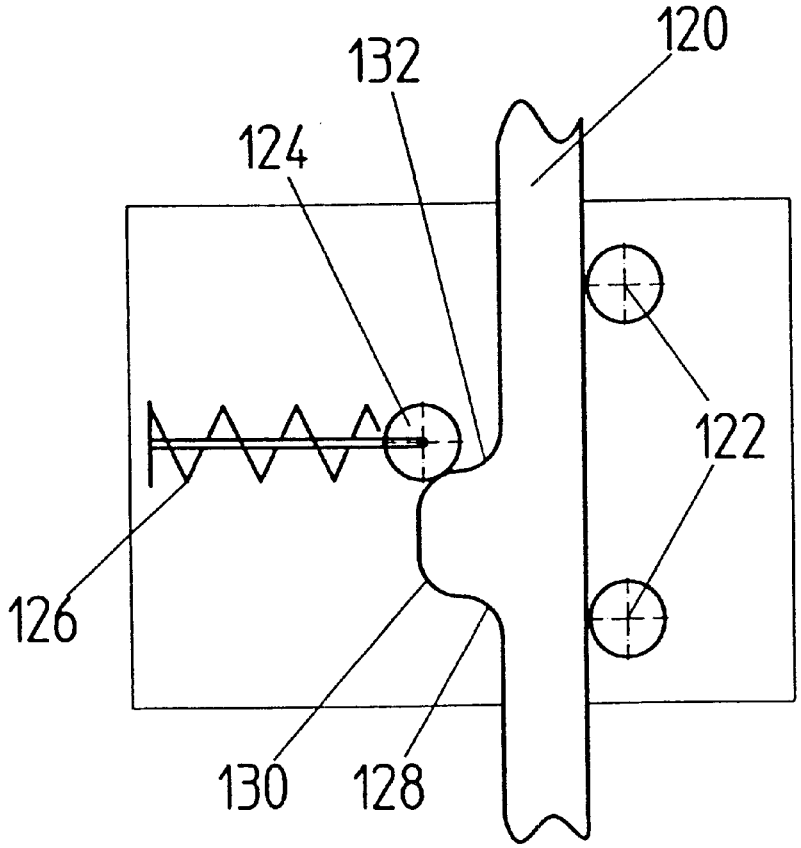

| | |
|---|---|
| FIG. 1 | a cross section through a switch having a system arranged according to the invention in a tie field, |
| FIG. 2 | a longitudinal section through the system of FIG. 1 with a tongue rail adjoining a rigid rail, |
| FIG. 3 | a cross section through the system of FIG. 2, |
| FIG. 4 | a representation corresponding to FIG. 2 in which the switch tongues are approximately in the second third of its adjustment path, and |
| FIG. 5 | a basic representation of a further embodiment. |

A section through a switch with a rigid rail 12 and a tongue rail 14 adjustable thereto is shown in FIG. 1. However, this should not restrict the teaching of the invention. Rather, it refers to the railroad track in which a first movable rail, such as the tongue rail 14, can be adjusted in relation to a stationary second rail, such as the rigid rail 12. For reasons of simplification, however, we shall always speak of the tongue rail 14 as first rail and rigid rail 12 as second rail in the following.

The rigid rail 12 is fastened in a known manner to a ribbed plate which can proceed from a tie. The tongue, in turn, is supported in a sliding manner on a sliding bed. In this respect, reference is made to sufficient constructions without the need for a more detailed description. The same applies with respect to the adjusting mechanism and to the lock for the switch tongue 14 itself.

As can be seen in the basic representation according to FIGS. 1 and 2, a tongue block 18 with a mounting support 20 proceeds from the foot 16 of the switch tongue 14, threaded shafts in turn proceeding from said mounting support 20, the threaded shafts leading to catch elements 26, 28 which are arranged in the tie field in a housing 30. The catch elements 26, 28 which have a rectangular geometry are supported on the shafts 32, 34 so as to slide, said shafts in turn being secured in the housing 30. Due to the connection between the tongue block 18 or its mounting support 20 with the catch elements 26. 28 via the threaded rods 22, 24 or similar elements, it is ensured that the catch elements 26, 28 move synchronously with the movement of the tongue rail 14 along the guide shafts 32, 34.

As illustrated especially in the sectional representation of FIG. 3, the catch elements 26, 28 have a rectangular cross section which results in an L-shape (catch element 28) or an asymmetrical T-shape (catch element 26) in the top view.

The teaching of the invention should also not be restricted by the corresponding geometries.

Furthermore, the threaded rods 22, 24 make it possible to adjust the distance to the tongue block 18.

In their surfaces 38, 40 facing one another, the catch elements 26, 28 each have a step 42, 44 by which the surfaces 38, 40 are divided into two sections 46, 48 or 50, 42, staggered vis-à-vis one another, and which are limited on the outside by the surfaces 49, 51 and 47, 53 which extend opposite and are preferably parallel to one another. The outer surfaces 47, 51 of the projecting sections 46, 50 extend parallel to one another and parallel to the adjustment path of the catch elements 26, 28 themselves. Recesses 54, 56 are provided in the outer, i.e. the corners, of the projecting sections 46, 50 of the catch elements 26, 28 that are far from the steps. The inset sections 48, 52 can, but do not have to, extend parallel to the shift path. Rather, they must only form a free space for one of the two roller elements 78, 80 when the other roller element interacts with one of the projecting surfaces 47, 51 that should be described as runoff surfaces.

Furthermore, two switch elements 58, 60 are allocated to the one catch element (catch element 28 in the example of the embodiment), said switch elements gliding along an outer surface 66 of the catch element 28 with their respective actuator 62, 64. The outer surface 66 thereby extends opposite surface 40 or 51 of the catch element 28 having the step 44.

There are also recesses 68. 70 in the surface 66 interacting with the actuators 62, 64 which are arranged in planes staggered vis-à-vis one another in such a way that a recess 68, 70 each is allocated to one of the actuators 62, 64 and the other recess is allocated to the other actuator. As a result, it is made possible that one of the actuators 62, 64 can engage in the recess 68, 70 allocated to it when the catch element 28 is adjusted, when the tongue rail 14 is in one of its final positions. To adjust the switching point, the catch element 28 and the catch element 26 can be adjusted via the threaded rod 24, 22 in relation to the tongue block 18 and thus to the tongue rail 14.

Between the catch elements 26, 28, the lever element 74 is pivoted about a stationary axis 72, said lever element being configured two-armed and having an L-shaped geometry with long and short arms 76, 82. The roller elements or slide rollers 78, 80, which are pivotable about axes that extend diametrically to the stationary axis 72 (not shown in greater detail), extend from the longitudinal arm 76 of the lever element 74. A hinged element 84 is pivoted about an axis 87 in the end area of the short arm 82. The hinged element 84 is configured plate-like or shaft-like and has a further axis 86 on its end that is distant from the axis 87, said axis being intersected by the retaining elements 88, 90. Furthermore, the hinged element 84 has a recess 85 on the roller side. The retaining elements 88, 90, which can also be called arm brackets, extend in tubular guides 92, 94 that are pivotable about stationary axes 96, 98 which extend from the housing 30 and extend parallel to the axes 87 and 72. The axes 86, 96, 98 are formed by bolt elements 100, 102, 104 which intersect the tubular guides 92 94 in their end areas or the arm brackets 88, 90 in their free front ends.

The tubular guides 92, 94 and the arm brackets 88, 90 are surrounded on the periphery by a coil spring 105, 106 or a similar element which, on the one hand, are supported on a peripheral collar 108, 110 of the arm brackets 88, 90 and, on the other hand, on a stop on the bolt side which projects from the tubular guide 92, 94.

The bolts 102 connecting the arm brackets 88, 90 thus also intersect the hinged element 84 which is also articulated with the lever element 74, i.e. its shorter arm 84 and the arm brackets 88,90.

Therefore, if the lever element 74 is turned, this movement is transmitted via the hinged element 84 to the arm brackets 88, 90 which can then be pressed in or out in the tubular guides 92, 94 by the force produced by the coil springs 105, 106. In this way, the lever element 74 and hinged element 84 more or less perform the function of articulated coulisse chain elements in order to transmit a movement or a force.

As seen in the representations of FIGS. 2 and 4, the lever element 74 or the longitudinal arm 76 with its rollers 78, 80 are directed to the catch elements 26, 28 in such a way that the rollers 78, 80 interact with the surfaces 47, 51 of the projecting sections 46, 50 facing one another, dependent on the position of the tongue rail 14, when the tongue rail 14 and thus the synchronous taking along of the catch elements 26, 28 in such a way that said tongue rail is secured, in addition, in its respective final position by the force produced by the coil springs 106, 105 via the arm brackets 88, 90, the hinged element 84 as well as the lever element 74 and the catch elements 26, 28 interacting with its rollers 78, 80. The movement is also preferably supported in the last third of the adjustment path vis-à-vis the final position.

In the corresponding positions, the final position is simultaneously controlled by means of the switch elements 58, 60 that can be configured as so-called snap switches.

The state of the system 10 according to the invention for securing and controlling the final position 14 in its abutting position is shown in FIG. 2. In this case, the roller 78 of the lever element 74 is located in the recess 54 of the catch element 26, whereby the forces acting from the coil springs 105. 106 on the arm brackets 88, 90 are transmitted via the hinged element 84 and the lever element 74 by means of the roller to the catch element 26 in such a way that the latter experiences the initiation of a force against an adjustment, i.e. against an upward movement in this embodiment. As a result, the tongue rail 14 is additionally secured in its abutting position. In order to transmit the necessary forces, the axis 87 in which the hinged element 84 is articulated with the lever element 74 extends, in this embodiment, above its axis of rotation 72, so that the lever element 74 endeavours to be turned clockwise with the result that the required force initiation is initiated in the catch element 26 counter to its adjusting direction. At the same time, the opposite roller element 76 engages in a recess 85 of the hinged element 84.

If the switch tongue 14 is adjusted away from the rigid rail 12, i.e. broken open, by means of an adjusting drive (not shown), then the roller element 78 of the lever element 74 slips out of the recess 54 and slides along the projecting surface 47. At the same time, the opposite roller element 76 slips out of the recess 85. As a result, the lever element 74 is turned counterclockwise about its axis 72. At the same time, an adjustment is made—downward, in the embodiment—via the hinged element 84 of the bolts 102 connecting the arm brackets 88, 90 away from the axis of rotation 72 of the lever element 74. The lever element 74 turns back, i.e. moves clockwise, at that moment when the roller or roller element 78 extends within the step 42 of the catch element 26 and the roller element 80 interacts with the projecting surface 51 of the section 50 of the opposite catch element 28. At this time, the lever element 74 turns clockwise. When the tongue rail 14 is moved further and thus the catch elements 26, 28 synchronously move along with it, the roller or roller element 80 is further supported on the surface 51 of the catch element 28 extending parallel to the adjustment path, in order to then reach into the recess 56 prior to the second final position of the tongue rail 14, i.e. its open position, whereby the force of the springs 106, 105 is transmitted due to the articulated connection between the hinged element 84 and the lever element 74 with the connecting bolt 102 in such away that the catch element 28 experiences a force initiation via the roller element 80, during simultaneous clockwise turning of the lever element 74, in such a way that it is moved upward in the embodiment, as a result of which the movement of the tongue rail 14 is supported in reaching its open position.

In other words, with the construction according to the invention, the forces of the springs 105, 106 are transmitted to one of the catch elements 26, 28 via the hinge connection 84 and the lever element 74, preferably in the last third of the adjustment path of the tongue rail 14, in such a way that the movement of the tongue rail 14 is supported. At the same time, each of the catch elements 26, 28 is positively secured in one of the final positions of the tongue rail 14 by engagement of one of the roller elements 78, 80 in one of the recesses 54, 56 or similar element.

As can be seen in the drawings, the distance between opposite surfaces 47, 49 or 51, 53 of the surfaces 38, 40 of the catch elements 26, 28 facing one another—seen in planes that extend at a right angle to the shift—is selected in such a way that, when one of the roller elements 78 or 80 interacts with a projecting surface 47 or 51, the other roller element is free. Furthermore, the distance of the steps 42, 44 between the surface sections 47, 53 or 59, 51—also seen at a right angle to the adjustment path of the catch elements 26, 28—is adjusted in such a way to the effective distance of the roller elements 78, 80 of the lever element 74 that, when one of the roller elements 78, 80 is disengaged from the corresponding roll-off surface 47, 51, the other roller element 80, 78 comes in contact with the other roll-off surface 51, 47.

It should also be noted that the interacting elements such as glide elements 78. 80, actuators 62, 64 and recesses 54, 56, 68, 70 can also be configured other than in the manner described. In particular, the recesses can be replaced by projections and the glide element and actuators adapted accordingly.

A basic representation of a further embodiment of a system for securing and/or controlling a tongue rail is shown in FIG. 5. A catch element in the form of, e.g. a rod 120, extends from the tongue rail that can be movably mounted between roller bearing 122 on the one hand and a roller element 124 on the other hand. The roller element 124 is thereby acted upon by a force by means of a spring element 126 in direction of the rod 120. The roller element 124 is floatably mounted so that it can be adjusted at a right angle to the longitudinal axis of the rod 120, i.e. to its shift path and the tongue rail. In this way, the roller element 124 with the spring element 126 and its guide (not described in greater detail) can be described as a retaining element. A coulisse 128, which is configured as a projection in the embodiment, extends from the rod 120. The coulisse 128 is thereby aligned to the tongue rail in such a way that the roller element 124 acts on one of the flanks 130, 132 of the projection 128 just prior to reaching the final position, with the result that the roller element, which, as noted above, can be adjusted at a right angle to the longitudinal axis of the rod 120, supports the shifting of the rod 120 due to the force produced by the spring 126. As a result, the tongue rail is synchronously supported in the respective final position when it is adjusted.

The effective width of the projection 128 should thereby be directed to the length of the adjustment path of the tongue rail in which no effective force should be transmitted via the roller element 124 to support the shifting of the tongue rail.

A switch element can be connected with the roller element 124 or its guide in order to generate a signal in dependency on the position of the guide or roller element 124, said signal enabling a control of the position of the tongue rail, in particular its final position. Of course, a separate signal generator can be allocated to the rod 120 which interacts with e.g. a further projection or recess of the rod 120 to release a signal. Analogous to the embodiment of FIGS. 1 to 4, several corresponding projections such as cams or recesses such as indentations can be provided to release several switch signals.

What is claimed is:

1. System (10) for securing and/or controlling the final position of a first rail (14), that can be adjusted in relation to a stationary second rail (12), wherein the first rail interact with at least one retaining element (88, 90) that is acted upon by a spring element (105, 106) and adjustable in relation to a guide element (92, 94) that is rotatable about a stationary first axis (96, 98), said retaining element in turn supporting the first rail in its perspective final position, characterized therein that, to the stationary first axis (96, 98) of the guide and retaining element (88, 90, 92, 94), a lever element (74) is pivoted about a second axis (72) which, is connected with the retaining element (88, 90) so as to be stationary and interacts with at least one catch element that extends from the adjustable first rail (14) in such a way that, in the respective final position of the first rail, the retaining element is acted upon by force in such a way that the respective final position can be supported and controlled, whereby the lever element (74) is articulated with the retaining element (88, 90) via a hinged element (84) articulated with the lever element via a third axis (86) which extends parallel to the first and second axes (96, 98; 72).

2. System according to claim 1, characterized therein that two catch elements (26, 28) extend from the adjustable first rail (14), one of the catch elements interacting with the lever element (74) in each of the final positions in such a way that the catch element is secured in position.

3. System according to claim 1, characterized therein that the lever element (74) is a two-armed element, wherein a glide element (78, 80) each sliding along each catch element (26, 28) is provided in sides opposite its swivel axis (72).

4. System according to claim 3, characterized therein that the glide elements (78, 80) are arranged in the respective end area of a straight arm or arm section of the lever element (74).

5. System according to claim 1, characterized therein that the lever element (74) has an L-shaped geometry.

6. System according to claim 3, characterized therein that one of the glide elements (78; 80) interacts with one of the catch elements (26; 28) each time the first rail (14) is in one of the final positions and the other glide element (80; 78) is disengaged from the other catch element (28; 26).

7. System according to claim 1, characterized therein that the retaining element (88, 90) is acted upon by spring tension in the direction of the first rail, in each of the final positions of the first rail (14).

8. System according to claim 1, characterized therein that the catch element (26, 28) has a recess (54, 56) in its surface (38, 40) interacting with the glide element (78, 80) of the lever element (74), the glide element engaging in one of the final positions of the first rail (14).

9. System according to claim 1, characterized therein that the recess (54, 56) in which the glide element (78, 80) of the lever element (74) engages in one of the final positions of the first rail (14) extends in the area of two surfaces of the catch element (26, 28).

10. System according to claim 1, characterized therein that the lever element (74) is arranged between the catch elements (26, 28) connected with the first rail (14), the glide elements (78, 80) of said lever element slide along surfaces (47, 51) of the catch elements facing one another.

11. System according to claim 1, characterized therein that the catch elements (26, 28) have two sections (46, 48, 50, 52), a projecting and inset section on their surfaces (38, 40) facing one another, the recess (54, 56), in which one of the glide elements (78, 80) engages when the first rail is in one of its final positions, being provided in each of the projecting sections.

12. System according to claim 11, characterized therein that the surfaces (47, 51) of the sections (46, 48, 50, 52) interacting with the glide elements (78, 80) are parallel to one another and also to the shift path of the catch elements (26, 28).

13. System according to claim 1, characterized therein that the sections (46, 50) forming the projecting steps (42, 44), seen diagonally to the shift path of the catch elements (26, 28), extend at a distance from one another in direction of the shift path.

14. System according to claim 1, characterized therein that at least one switch element (58, 60) interacts with at least one of the catch elements (26, 28) in such a way that a signal can be generated in the respective final position of the first rail (14).

15. System according to claim 1, characterized therein that, to control the final positions, at least one switch element is provided that is configured integrally with the catch element and/or is an element or part of the element also moved by the first rail.

16. System according to claim 1, characterized therein that two switch elements (58, 60) are provided, each switch element generating a signal when the first rail (14) is in one of its final positions.

17. System according to claim 1, characterized therein that the switch element (58, 60) has an actuator (62, 64) which slides along a surface (66) of one of the catch elements (28).

18. System according to claim 1, characterized therein that indentations or projections (68, 70) are provided in the surface (66) of the catch element (28) interacting with the actuators (62, 64) and that a recess or a projection always interacts with the actuator (62, 64) when the first rail (14) is in one of its final positions.

19. System according to claim 1, characterized therein that the actuators (62, 64) interact with a surface (66) of the catch element (28) that extends opposite to that surface (40) along which one of the glide elements (80) of the lever element (74) slides.

20. System according to claim 3, characterized therein that the glide element (78, 80) of the lever element (74) only slides along the projecting section (46, 50) of the surface (38, 40) of the catch element (26, 28).

21. System according to claim 1, characterized therein that the system (10) comprises two guide elements (92, 94), which are pivotable about each of the stationary first axes (96, 98) that are parallel to one another, that the retaining element (88, 90) forming an arm bracket that is axially movable in relation to the guide element, extends within said guide element or partially surrounds it, that each retaining element is prestressed vis-à-vis the guide element by means of the spring element (105, 106) preferably surrounding it and that the retaining elements can be turned in relation to one another about the common third axis (86) extending parallel to the stationary first axis, the hinged element (80) that is articulated with the lever element (74) extending from said third axis.

22. System according to claim 21, characterized therein that the third axis (86) connecting the retaining elements (88, 90) can be adjusted along a straight line which extends parallel or almost parallel to the shift path of the catch element(s) (26, 28).

23. System according to claim 1, characterized therein that the respective interacting guide and retaining elements (88, 92, 90, 94) extend symmetrically to the straight line which extends parallel or almost parallel to the shift path.

24. System according to claim 1, characterized therein that, independent of the position of the first rail (14), the third axis (86) intersecting the retaining elements (88, 90) always extends on a side of a straight line connecting the stationary first axes (96, 98).

25. System according to claim 24, characterized therein that the second axis (86) intersecting the retaining elements (88, 90) extends between the straight line connecting the first axes 996, 98) and the first rail (14).

26. System according to claim 1, characterized therein that the catch element (26, 28) intersects a guide shaft (32, 64) along which the catch element slides.

27. System according to claim 26, characterized therein that the guide shaft (32, 34) extends from a mounting support or a housing (30).

28. System according to claim 1, characterized therein that a block which is connected with the catch element (26, 28) via a fastening element.

29. System according to claim 28, characterized therein that the distance between the catch element (26, 28) and the block (18) can be adjusted.

30. System according to claim 1, characterized therein that the guide and retaining elements (88, 90, 92, 94) are arranged in a first plane and the catch elements (26, 28) in second plane, extending parallel thereto, in the mounting support or housing (30).

31. System according to claim 1, characterized therein that the catch element (26, 28) has a rectangular shape with a plane extending at a right angle to the axes (96, 98, 72, 86).

32. System according to claim 1, characterized therein that the hinged element (80) has two axes of rotation (86, 87), a first axis of rotation of which is the third axis (86) intersecting the retaining element (88, 90) and the second axis of rotation intersecting an arm section (82) of the lever element (74), and that the hinged element comprises a plate or fishplate element that has a recess (85) in its peripheral area on the lever element side, the glide element (76) of the lever element (74) close thereto engaging in said recess in one of the end positions of the first rail (14), the other glide element (78) simultaneously engaging in the recess (54) of one of the catch elements (26) allocated to the final position corresponding to the abutting position, wherein the axis of rotation of the retaining element forming the second axis (72) extending between the third axis (86) of the retaining element (88, 90) and the second axis of rotation (87) of the hinged element (84).

33. System (10) for securing and/or controlling the final position of a first rail (14), that can be adjusted in relation to a stationary second rail (12), wherein the first rail interacts with at least one retaining element (88, 90) that is acted upon by a spring element (105, 106), said retaining element in turn supporting the first rail in its respective final position, characterized therein that, stationary to the stationary first axis (96, 98) of the guide and retaining element (88, 90, 92, 94), a lever element (74) is pivoted about a second axis (72) which is connected with the retaining element (88, 90) and interacts with at least one catch element (26, 28) that extends from the adjustable first rail (14) in such a way that, in the respective final position of the first rail, the retaining element is acted upon by force in such a way that the respective final position is supported and that, to control it, at least one switch element (58, 60) is allocated to the catch elements via which a switch signal can be generated when the rail is in a final position.

34. System (10) for securing and/or controlling the final position of a first rail (14), that can be adjusted in relation to a stationary second rail (12), wherein the first rail interacts with at least one retaining element (124) that is acted upon by a spring element (126), said retaining element in turn supporting the first rail in its respective final position, characterized therein that a catch element (120) extends from the adjustable first rail (14), said catch element interacting with the retaining element in such a way that the retaining element is acted upon by pressure in the respective final position of the first rail in such a way that the respective final position is supported and controlled.

35. System according to claim 34, characterized therein that the retaining element (124) can be adjusted under spring tension at a right angle or almost at a right angle to the shift path of the catch element (120) and interacts with a coulisse (128) extending from the catch element in such a way that the first rail (14) is supported by the spring tension transmitted by the retaining element in its movement into the final position prior to reaching one of its final positions.

36. System according to claim 35, characterized therein that the coulisse (128) is a projection or an indentation of an effective width which corresponds to the first rail (14) in its adjustment path length supported by the retaining element (124).

37. System according to claim 34, characterized therein that at least one signal generator is allocated to the catch element (120) which generates signals that can be allocated to the adjustment path.

38. System according to claim 37, characterized therein that the signal generator and the retaining element (124) are coupled directly.

39. System according to claim 37, characterized therein that the signal generator extends from the catch element (120) and can be actuated by the retaining element (124).

* * * * *